United States Patent [19]

Kempton

[11] 4,026,213

[45] May 31, 1977

[54] SELECTIVELY AIMABLE WARHEAD

[75] Inventor: Marvin L. Kempton, Socorro, N. Mex.

[73] Assignee: The United States of America as represented by the Secretary of the Navy, Washington, D.C.

[22] Filed: June 17, 1971

[21] Appl. No.: 154,203

[52] U.S. Cl. ..... 102/56 SC; 102/67; 102/DIG. 2

[51] Int. Cl.[2] ..... F42B 13/18

[58] Field of Search ..... 102/56, DIG. 2, 67

[56] References Cited

UNITED STATES PATENTS

| | | | |
|---|---|---|---|
| 3,136,251 | 6/1964 | Witow | 102/70.2 P |
| 3,565,009 | 2/1971 | Allred et al. | 102/56 |
| 3,661,088 | 5/1972 | Harr et al. | 102/DIG. 2 |

*Primary Examiner*—Verlin R. Pendegrass

*Attorney, Agent, or Firm*—Richard S. Sciascia; Paul N. Critchlow

[57] ABSTRACT

The cylindrical warhead has an outer, relatively-thin metal skin member and an inner thicker metal casing, the main explosive charge being disposed in the space between the members with associated boosters or charge initiators. The initiators include a first set of circumferentially-spaced aiming detonation members and a second set of similarly spaced main charge-firing members. Aiming is achieved by first firing a selected aiming initiator to produce a force sufficient to rupture and break open an arcuate section of the outer warhead skin but insufficient to produce a main charge detonation. Next, a main charge-firing initiator disposed substantially diametrically opposite the ruptured arcuate section is fired to produce an inwardly-directed main-charge blast for fragmenting the thicker inner casing and driving the fragments in the desired direction through the ruptured arcuate section.

7 Claims, 12 Drawing Figures

INVENTOR.

MARVIN L. KEMPTON

INVENTOR.
MARVIN L. KEMPTON

FIG. 4.
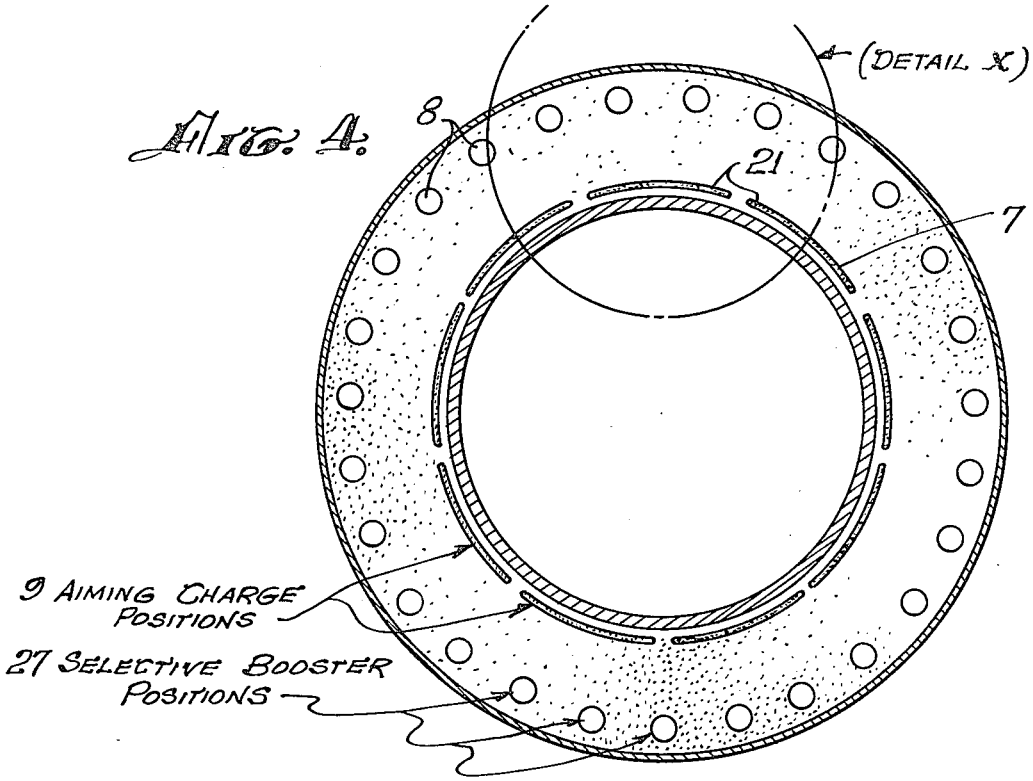
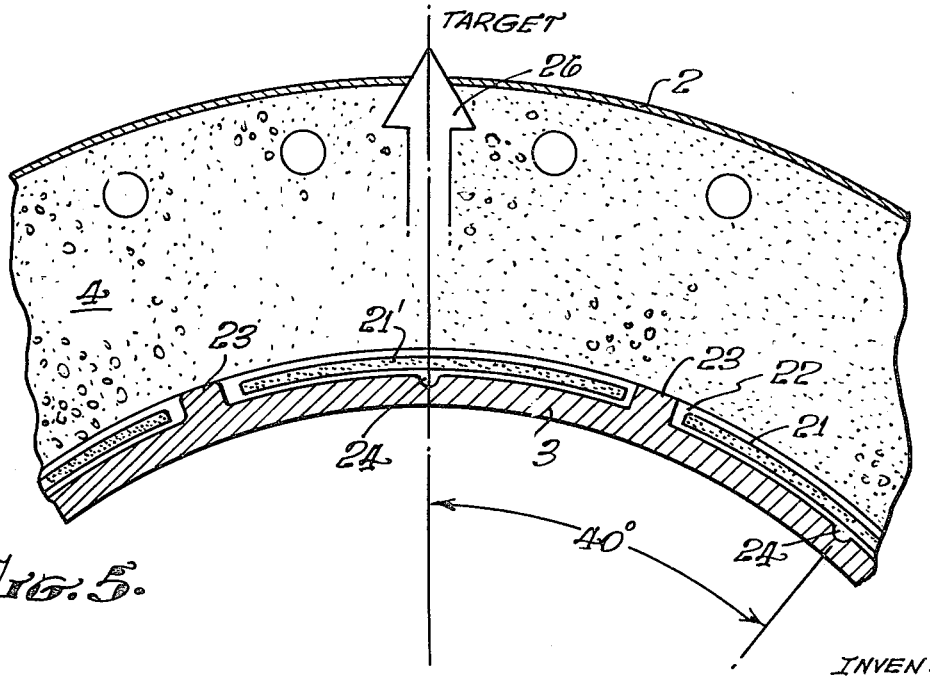
FIG. 5.
INVENTOR.
MARVIN L. KEMPTON

INVENTOR.
MARVIN L. KEMPTON

INVENTOR.

MARVIN L. KEMPTON

SELECTIVELY AIMABLE WARHEAD

BACKGROUND OF THE INVENTION

The present invention relates to explosive warheads and, in particular, to aimable warheads capable of producing a blast fragment pattern directed toward a desired target.

Evaluations of the performance of current missile systems reveal a number of shortcomings that have prevented the achievement of the degree of effectiveness needed to disable or, in other words, structurally kill the tougher and sometimes faster targets encountered in mordern-day combat. Also, anticipated developments make it rather apparent that conventional missile systems will not be able to fully meet this challenge without significant warhead improvements in terms of increased kill radii as well as substantial increases in the energy density and velocity of the warhead fragments producing the target damage. Although target effectiveness obviously can be increased directly with increases in the mass density and striking velocity of the payload fragments, these parameters are met by some very stringent limiting factors, such as the maximum available space, weight and other system requirements.

Conventional warheads for the most part are cylindrical members in which the blast fragment payload is packed in suitable manners on the outer shell or skin of the warhead while the explosive is carried centrally interiorly of the skin and payload. Blast patterns from such warheads are circular to the extent that the pattern propagates in all directions around the 360° circumference of the warhead. Such a warhead, for example, as shown in U.S. Pat. No. 3,228,336 "Rod Warhead" issued Jan. 11, 1966 to Marvin L. Kempton.

As is apparent, 360° blasts of this type dissipate energy in all directions rather than concentrate it in a desired target direction and, to this extent, a significant portion of the energy is lost. Some effort, of course, has been directed toward directionally concentrating or aiming the blast pattern so as to increase the kill radius and permit substantial increases in fragment density and velocity. For example, the principle of shaped charges has been applied but, as far as is known, there have been no significant improvements along this line.

SUMMARY OF THE INVENTION

The present invention provides a selectively aimable warhead adapted for use with a missile that carries the warhead into close proximity with the target and also senses or determines the radial direction of the target relative to the warhead. Sensors capable of performing this function have been developed for the U.S. Navy although, as will become apparent, such sensors are not a part of the present invention which instead is concerned wholly with improvements in the warhead proper. In this regard, it might be noted that, although the term warhead sometimes includes the missile component, it presently is used to designate only the fragment-carrying explosive component carried by the missile.

Preferably, the warhead has a cylindrical geometry including a cylindrical outer shell or skin member and an inner casing member disposed within the skin member to provide an intervening sleeve-like space in which the explosive charge is packed or otherwise disposed. The inner casing is relatively thick and it may be formed of a metal such as steel or other material which, when fragmented, provides fragments having physical characteristics needed to produce the intended structural damage. Conventional initiators, also known as boosters or detonators, are associated with the explosive charge to induce detonation of the charge.

Selective aimability is achieved by using first and second sets of circumferentially-spaced aiming initiators and main, charge-firing initiators. The first set of aiming initiators are individually disposed to produce an outwardly-directed blast force capable of disrupting or, at least, disabling an arcuate section of the skin nearest to it. In one form, 24 such aiming initiators are spaced at 15° intervals. The main initiators, which also may be spaced at 15° intervals, are used to induce a main charge detonation capable of fragmenting the inner casing and driving the fragments toward the target through the previously-disrupted arcuate section of the warhead skin. By selecting the appropriate aiming and main initiators, the blast pattern can be aimed or directed so that its energy is concentrated in the target direction rather than being dissipated in a 360° pattern. Suitable means are employed to produce a fractional millisecond delay between the firing of the aiming and the main initiators so that the detonations produced by the two are successive in their actions. Obviously, the aiming necessarily requires the selection of the aiming initiator capable of producing an arcuate rupture radially aligned with the target. The main initiator selected from the second set also is a radially-aligned initiator located diametrically opposite to this arcuate section of the warhead skin. The force produced by the aiming initiator is controlled or restricted to the extent that it is insufficient to detonate the main charge although, as stated, it is sufficiently large to rupture or at least disrupt the thinner outer skin of the warhead. In contrast, the force produced by the main initiator is sufficient to induce a main charge detonation that ruptures the thicker inner casing. The timing of the aiming and main initiator firings has a minimal delay so that the blast fragments produced by rupturing the thicker casing tend to follow in the path of the outwardly-directed force produced by the rupturing of the outer skin.

THE OBJECTS OF THE INVENTION

It is therefore a primary object of the present invention to provide a selectively aimable warhead capable of responding to a sensed target direction for producing a blast pattern aimed in that direction.

Another important object is to utilize the selective aiming principle to provide a warhead having a substantially increased blast pattern density, velocity and kill radius.

Another related object is to provide an aimable warhead in which the effectiveness or kill probability (Pk) is significantly increased.

Another important object which will become clearer in subsequent description is to provide a warhead in which the total amount and weight of the fragmenting material is substantially increased.

Other objects and their attendant advantages will become more apparent in the ensuing description.

BRIEF DESCRIPTION OF THE DRAWINGS

The invention is illustrated in the accompanying drawings of which:

FIG. 4 is a schematic view also similar to FIG. 2, this view showing a third, functionally-distinct embodiment;

FIG. 5 is an enlargement of Detail X of FIG. 4;

DETAILED DESCRIPTION OF THE INVENTION

Figure 1:
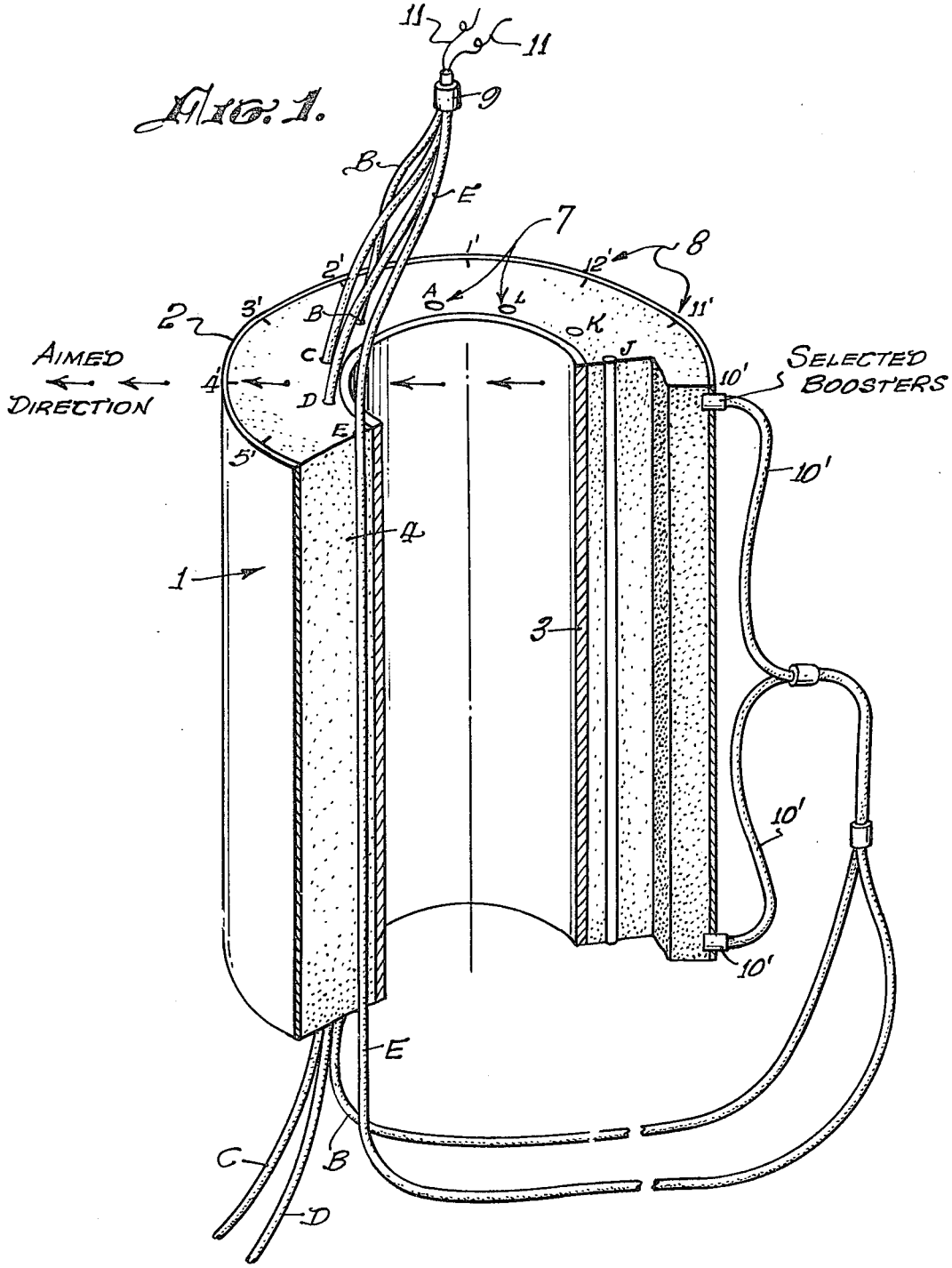
FIG. 1 is a perspective of one embodiment of the warhead with an arcuate section broken away to show interior parts and arrangements.

Referring to FIG. 1, it will be seen that the present warhead has a cylindrical configuration provided by a relatively-thin, metallic outer shell or skin member 2, a concentrically-disposed inner, metallic casing or liner 3 and a high energy explosive substance 4 completely filling the sleeve-like space between these two concentric members. For reasons which will become more apparent, casing or liner 3 is substantially thicker and stronger than skin member 2. For example, for a warhead using a 2 inch sleeve of a high energy explosive, such as C-4, the inner casing may be about 3/16 inch while the outer skin is about 1/16 inch.

The warhead usually will be carried by a missile which may or may not incorporate a propulsion unit and, usually, the missile will have sections which project forwardly and rearwardly of the cylindrical warhead component shown in FIG. 1. If the warhead is encased within a missile skin, the arrangement will be generally along the line illustrated in FIG. 2 in which the missile skin is designated by numeral 6.

Detonation of the explosive 4 is intended to be accomplished in conventional manners by the use of primed initiators or boosters which, with important exceptions to be noted, may assume a wide variety of arrangements. One of these exceptions is the particular geometric disposition of these boosters relative to the explosive. Thus, as shown in FIG. 1, there are two sets 7 and 8 of booster or initiator members, set 7 being a circumferentially-spaced set of aiming initiators that includes twelve individual initiators A–L. Similarly, set 8 is a set of twelve circumferentially-spaced individual main, charge-firing initiator members 1–12. Each of the embodiments of the present invention utilizes the separate sets 7 and 8 and, as may be noted, set 7 is disposed near the inner periphery of the explosive charge, while set 8 is disposed near its outer periphery.

The circumferential spacing of these two sets is a functionally significant part of the present invention since it is this feature which enables the selective aiming to be achieved. The longitudinal or axial disposition of the individual boosters relative to the warhead is a matter that to some extent is discretionary. For example, FIG. 1 illustrates a warhead in which a double-ended booster arrangement is employed for main charge-firing initiators 1–12 of set 8. In other words, these initiators, such as initiators or boosters 10′, are disposed one at each end of the explosive charge. The double-ended main, charge-firing initiator or booster arrangement has some advantages although, when used in the present selectively-aimable warhead, there appears to be some tendency for the blast produced by the detonation to have a slight cross over pattern. For this reason, it may be desirable to use a single-ended arrangement or to increase the number of boosters along the axial length of the warhead.

The aiming initiators of set 7, however, have a somewhat different configuration since, as has been explained, the force produced by firing the aiming initiators preferably should be below the threshold required for the detonation of main charge 4. To achieve this desired result the aiming initiators, as shown in FIG. 1, can be simply the length of a primacord line, such as line E, that is run through main charge 4. Primacord lines customarily are used to energize boosters such, for example, as main boosters 10′. In a structural sense, these lines are lengths of wrapped explosive which, when fired, produce a force that is considerably attenuated in a radial direction by their wrapping. In an axial direction their force is not so attenuated and it is for this reason that boosters 10′ are shown in FIG. 1 each as being the end portion of a primacord pointed axially at the main charge. Thus, boosters 10′ detonate the main charge by their full force into the charge. To detonate the main charge a threshold force of 20,000 psi may be required and this threshold is met by the axial detonation of the primacord.

Conversely, the force exerted by the primacord detonation in a radial direction can be attenuated to about 1000 psi by the wrapping of the cord and this reduced force is well below the threshold required for main charge detonation. Nevertheless, it is sufficient to disrupt or rupture a proximate section of the relatively thin outer skin 1 of the warhead.

Another important feature of the present invention is the fact that booster or initiator sets 7 and 8 are intended to be fired successively or, in other words, there is a designed time delay between the energization of an aiming booster of set 7 and a subsequent energization of a main charge-firing initiator of set 8. The delay contemplated for present purposes is in the order of ¼ millisecond and, in the embodiment shown in FIG. 1, such a delay can be built directly into the primacord lengths which supply the members of both sets in what amounts to a looped arrangement. In this regard, it might be noted that the FIG. 1 arrangement essentially is a test configuration in which the initial signal or impulse for firing the initiators is manually applied and for this purpose, the primacord lines can be gathered at a particular junction 9 supplied by leads 11 which carry the signal impulses derived from the manual source.

Figure 2:
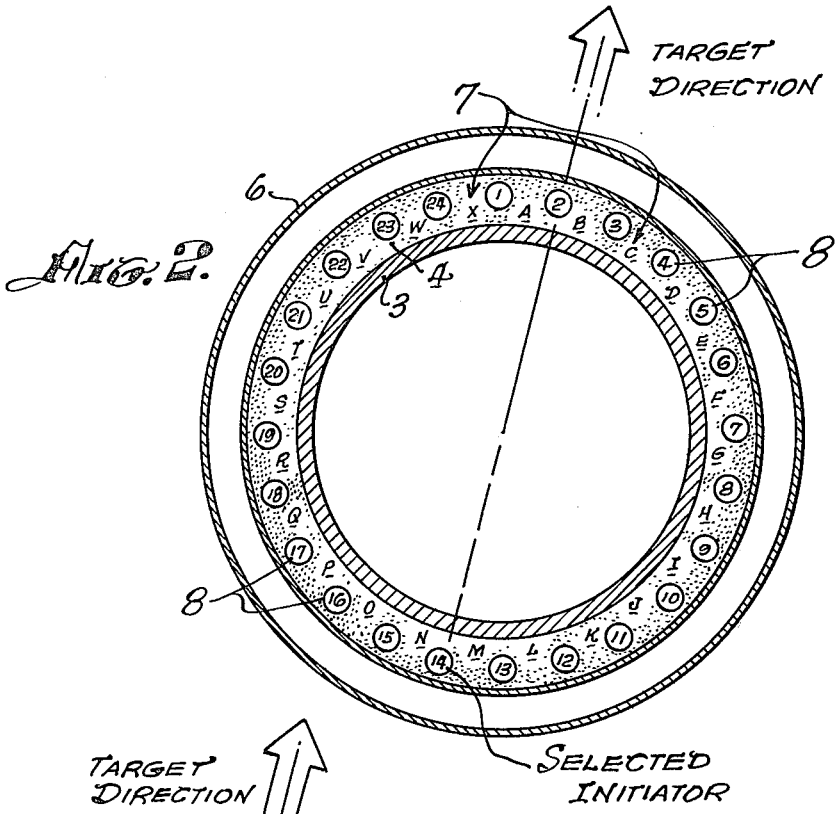
FIG. 2 is somewhat schematic horizontal section of the warhead illustrating another embodiment having a particular circumferentially-spaced arrangement of the explosive boosters of initiators.
Figure 3:
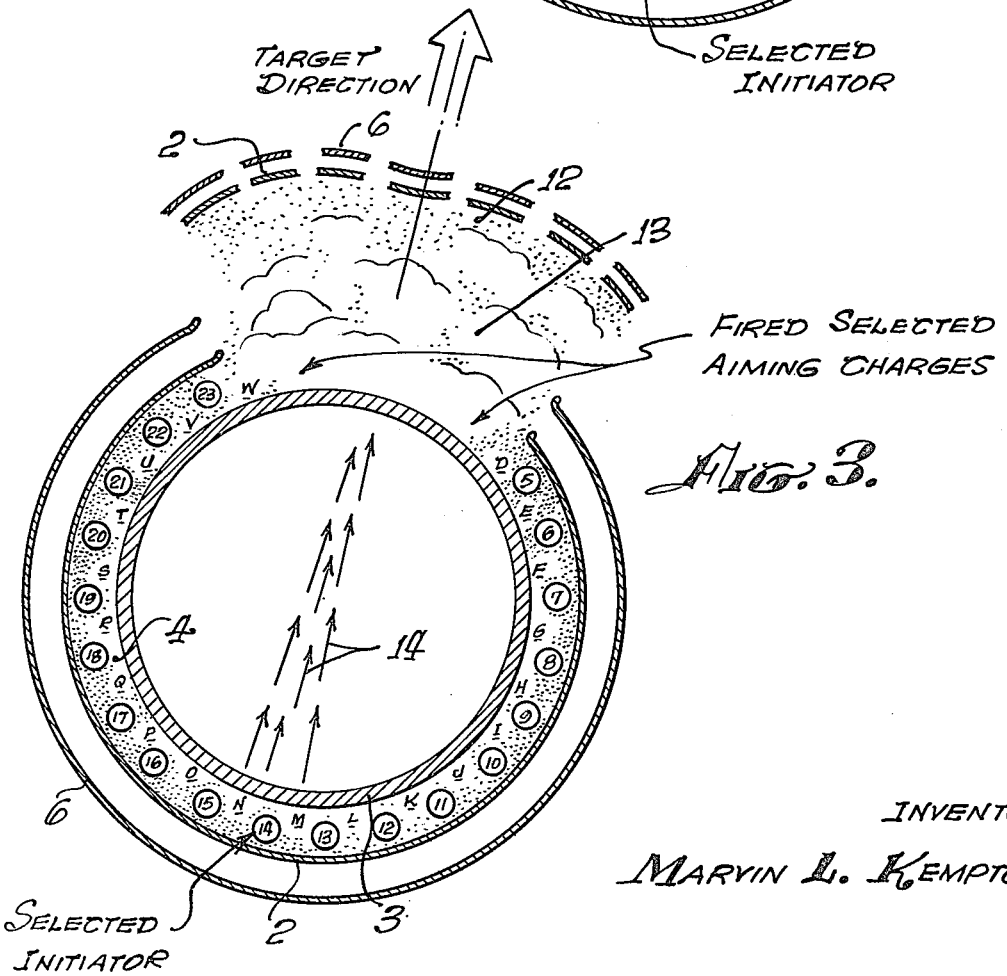
FIG. 3 is a view similar to FIG. 2 illustrating the effects of firing the so-called aiming initiators.
Figure 9:
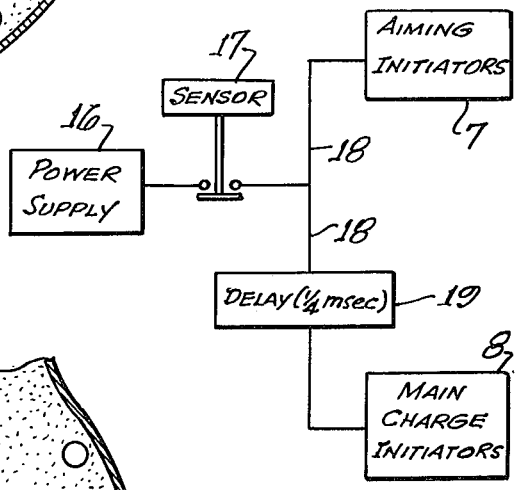
FIG. 9 is a block diagram of a system for firing the aimable and main charge initiators used in the present invention.

The operational embodiment of the present warhead can better be understood with reference to the remaining FIGS. 2–8 taken in conjunction with the firing system shown in block form in FIG. 9. FIGS. 2 and 3 differ from the FIG. 1 embodiment principally in that booster sets 7 and 8 each include 24 individual boosters spaced at 15° intervals rather than the 12 booster sets of FIG. 1.

A primary feature of the invention is to produce a selectively aimable warhead and, to achieve this end, the present invention contemplates the steps of first selecting one or more aiming boosters, such as booster members (X, A, B, C) of FIG. 2 and firing these particular members. The resulting detonation, as shown in FIG. 3, disrupts the arcuate section of the warhead skin and the outer missile skin lying radially outwardly of these selected initiators leaving an opening 13 in the skin. The heavier and stronger casing 3 resists the blast and maintains its structural integrity.

Immediately following the firing operation illustrated in FIG. 3, a preselected main, charge-firing initiator, such as initiator 14', is fired to produce a main charge detonation that causes a section of warhead casing 3 disposed radially inwardly of this initiator to break apart or fragment. The major portion of this main charge explosive force thus is directed along the path indicated by arrows 14 of FIG. 3. To achieve this result it is important that the main, charge-firing initiator selected for the detonation be one or more of the initiators disposed diametrically opposite to the arcuate portion of the warhead skin which has been explosively removed upon the first firing of the aiming charge initiators. Thus, for example, the main, charge-firing initiator selected for the illustrated detonation is initiator 14 which is approximately diametrically opposite to opening 13. Arrows 14 which indicate the direction of the main, charge explosive force also designate fragments produced by a breaking apart of warhead casing 3. These fragments are proceeding in the target direction which is indicated by the large arrow at the top of FIG. 3.

It, of course, is recognized that once the high energy explosive has been fired or detonated at any one location, the detonation will propagate from that location in both rotational directions. When main charge initiator 14 is fired, the detonation will proceed in both directions from its location. However, in the present warhead, the time interval between charges is so slight (¼ millisecond) that the detonation produced by the aiming charges barely has time to disrupt or disable the desired arcuate section of the missile skin before the firing of, for example, main charge initiator 14. Consequently, when main charge initiator 14 is fired, there is a preexisting rush of the rapidly expanding gases and other products of combustion through the ruptured section of the warhead skin in the direction of the target. This expanding force in the direction of the target carries the warhead casing fragments produced by the detonation of main charge initiator 14 in its general direction. As the detonations propagate in both directions, the remaining portions of the warhead skin as well as the warhead casing will rupture and fragment but, as has been established in test operations, the major portion of these fragments tend to follow in the target direction indicated by the arrow of FIG. 3. Consequently, by selecting particular aiming initiators to initially disrupt or at least disable desired sections of the warhead skin and then by detonating a main charge initiator diametrically opposite to this portion in timed relationship using a minute delay in the order of fractional milliseconds, the present warhead is capable of releasing its explosive blast in any desired arcuate direction.

It no doubt has become apparent at this point of the description that the means for selecting the particular initiators to be fired is an important consideration. Such a means obviously should be able to sense the radial direction of the target relative to the warhead when the warhead has been carried by its missile into proximity with the target or, in other words, into a position in which it is within its kill radius. However, even though this radial direction sensor means is important for the interception and destruction of airborne targets, the sensor is not itself a part of the present invention. If desired, the selection can be made manually or by remote control rather than being dependent upon a particular sensor carried by the missile. However, the proximity fusing has been developed to the point which permits the sensor to be carried by the missile and to generate a signal representative of the radial direction of the target. One such sensor capable of achieving the present purposes has been developed for the U.S. Navy and is known within Navy ordinance as the Aztec fuse.

FIG. 9 illustrates in block form a system using a sensor such as the Aztec fuse. As shown, the block diagram of FIG. 9 includes a power supply 16, a sensor mechanism 17, initiator sets 7 and 8 coupled together by line 18 which includes a delay mechanism 19 that may be provided in any conventional form or which may be built directly into the power transmission line. Power supply 16 as well as sensor 17 are intended to be carried by the missile proper rather than by the warhead. Sensor 17, as already stated, generates a signal representative of the radial direction of the target and when so sensed closes the power supply line to the initiators and permtis the signal generated by the sensor to be applied in a successive manner achieved through delay mechanism 19 to a desired aiming initiator and a desired main charge-firing initiator. If, for example, a single aiming initiator is to be used for the initial rupturing of the warhead skin, the arrangement is such that the sensor signal generated by its proximity to the target fires this particular initiator. When there are 24 aiming initiators in set 7, sensor 17 produces 24 separate signals each of which initiates the firing of a selected and coupled initiator. A desired main charge initiator will be fired in a minutely delayed sequence. Since one of the critical aspects of the arrangement is that the selected main charge-firing initiator must be the initiator substantially or approximately diametrically opposite the selected aiming charge initiator, the circuitry needed to couple the sensor signals to both of these initiators becomes relatively simple. In other words, the sensor can determine which of the aiming charge initiators is to be fired and, dependent upon this selection, a particular main charge initiator then is successively fired. Again, however, it must be emphasized that the manner of applying a sensing signal to the selected initiators primarily is a refinement rather than an integral part of the present invention. Instead, the invention is concerned solely with the warhead construction which provides the directional blast pattern by utilizing the circumferentially-spaced sets of initiators and further, by incorporating the concept of causing the blast of the main charge-fitting initiator to be directed inwardly so as to fragment a metal liner or casing disposed radially inwardly of the explosive charge. In this regard, it can be noted that prior warheads for the most part utilize an arrangement in which the metal fragments are carried radially outwardly of the explosive charge as opposed to the radially-inward arrangement of the present warhead.

Another embodiment of the invention is illustrated in FIGS. 4–8 and, in practice, this particular arrangement has demonstrated its ability to produce an increased kill radius and generally appears to be quite promising.

Referring to FIG. 4, the arrangement of set 8 of the main, charge-firing initiators is essentially the same as that described with reference to FIG. 2. However, the arrangement of set 7 of the aiming initiators is somewhat different. Thus, instead of using a set of 24 individual boosters or initiators, FIG. 4 uses nine initiator-detonators 21 each in the form of a flexible detonation sheet known in the art as Datasheets. These explosive sheets are better shown in FIG. 5 which is an enlargement of Detail X of FIG. 4. As there seen, each detonator sheet 21 which, as will be appreciated, extends the longitudinal or axial length of the warhead, is mounted in a trough or notch 22, there being nine such troughs 22 spaced circumferentially on the outer peripheral surface of warhead casing 3. In effect, the outer surface of casing 3 is formed into successive troughs 22 spaced one from the other by ridges or detents 23. Centrally of each trough 22 is a longitudinal notch 24 which further weakens the rigidity and strength of the casing member along its longitudinal extent. The result is that, when detonators 21 are fired, the explosive force resulting from their being fired causes casing 3 to break and bend inwardly in the manner shown in FIGS. 6 and 7. Again, the datasheets have their radial force attenuated by their cover which in this instance may be a thin metal sheet. Also, ridges 23 of the casing protect adjacent datasheet members from being detonated by the firing of the particular datasheet which has been selected. Without this protection the datasheet detonation might proceed circumferentially around the warhead to interfere with the desired selective aimability.

The manner in which these structural modifications of FIG. 5 function when the warhead is fired can be described with reference to target direction arrow 26 shown in FIG. 5. Thus, if the target is in the general direction of the arrow, a radial direction signal is generated or applied to flexible detonator sheet 21′ the center of which is aligned with a diameter of the warhead which itself is aligned with the target. When fired, the resulting blast force disables or disrupts outer skin 2 in the manner described with reference to FIGS. 2 and 3. In addition, the explosive force is directed inwardly to cause warhead casing member 3 to break along the line or notch 24 and further to cause the two sides of the break to bend inwardly in the manner shown in FIG. 6. More specifically, the inward bending of these two halves of the break each are hinged along the lines of adjacent notches 24 in the manner shown in FIG. 7. As already indicated, the placing of the sheets in the individual troughs permits the blast force to concentrate along the weakened portion of notches 24 and produce the desired break. The remainder of the blast proceeds in the same manner as that previously described with reference to the earlier figures. Thus, a main charge initiator disposed dismetrically opposite to aiming charge initiator 21 is successively fired to produce a fragmentation of the metal of casing 3 and cause the products of the explosion and fragments to be driven through the aperture produced by the hinged breaks of the casing as well as the rupturing of the warhead skin.

Figure 6:
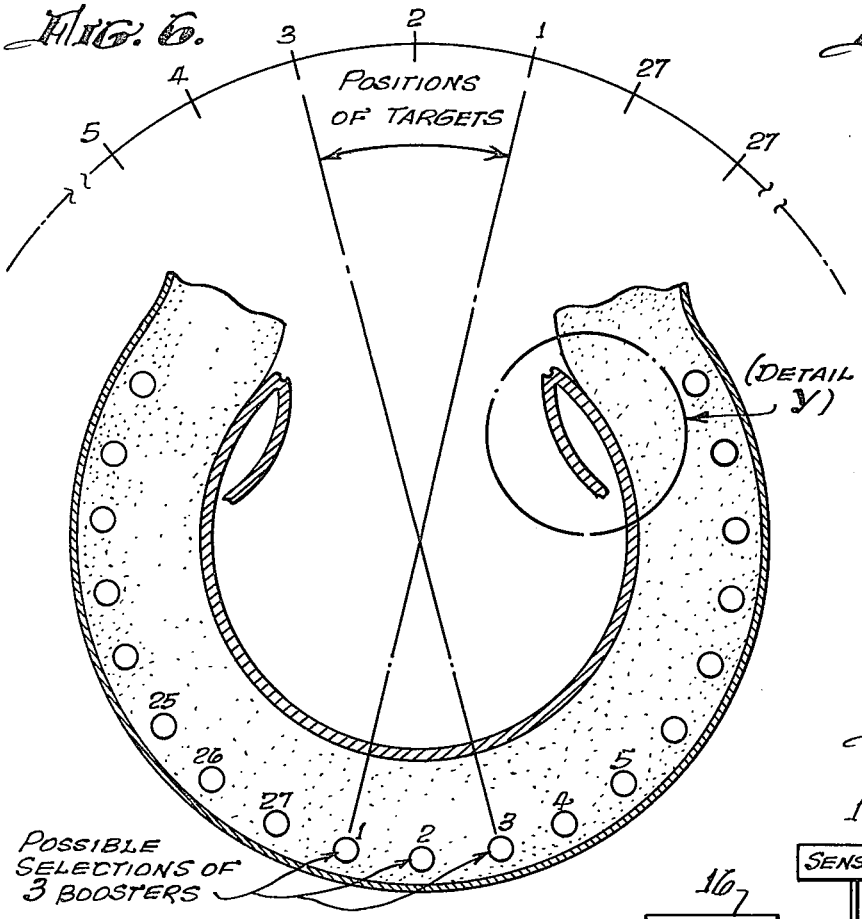
FIG. 6 is a view similar to FIG. 4 showing the effects of firing certain initiators shown in FIG. 4.
Figure 7:
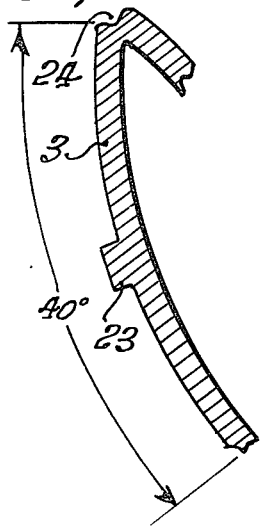
FIG. 7 is an enlargement of Detail Y of FIG. 6.
Figure 8:
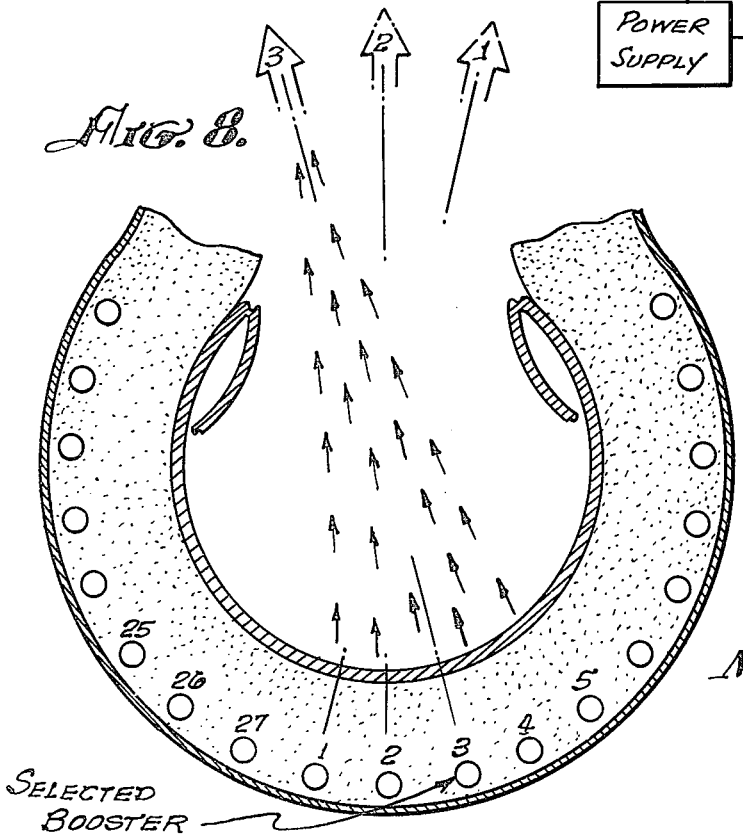
FIG. 8 is a functional view schematically showing the intended effects of firing a selected aiming initiator.

FIGS. 6 and 7 also illustrate the fact that the hinge-like breaking of the casing permits any one of three or more main charge initiators to be employed. Thus, if the target position is in any one of the positions identified as positions 1, 2 or 3 of FIG. 6 or 8, any one of the main, charge-firing initiators 1, 2 or 3 can be used. In FIG. 8, the target is disposed along the line indicated by arrow 3 and the selected initiator is the one numbered 3. This same selection can be utilized in the previous embodiment as long as the arcuate section of the wall which has been removed is of sufficient length.

Figure 10:
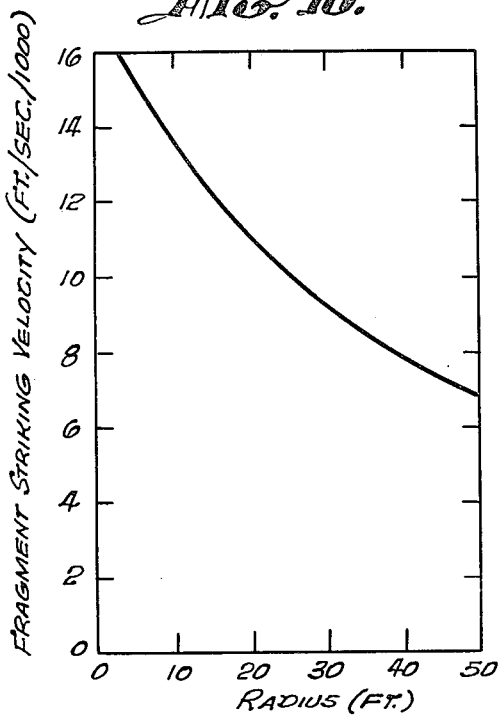
FIGS. 10, 11 and 12 are plots showing test results for a particular test configuration.
Figure 11:
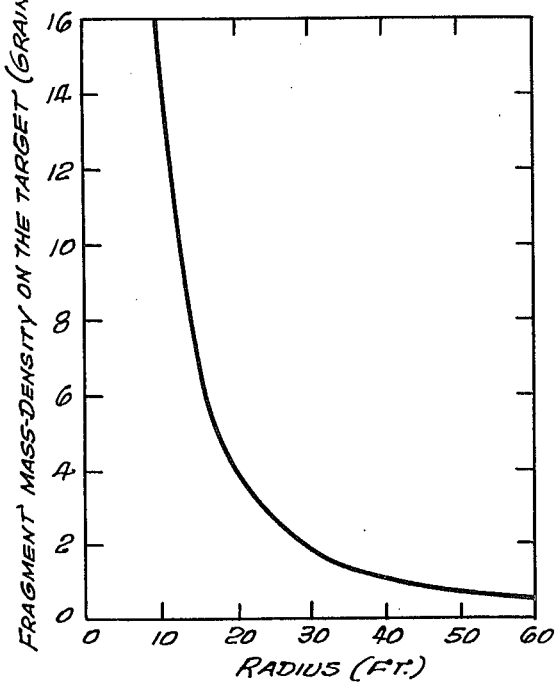
Figure 12:
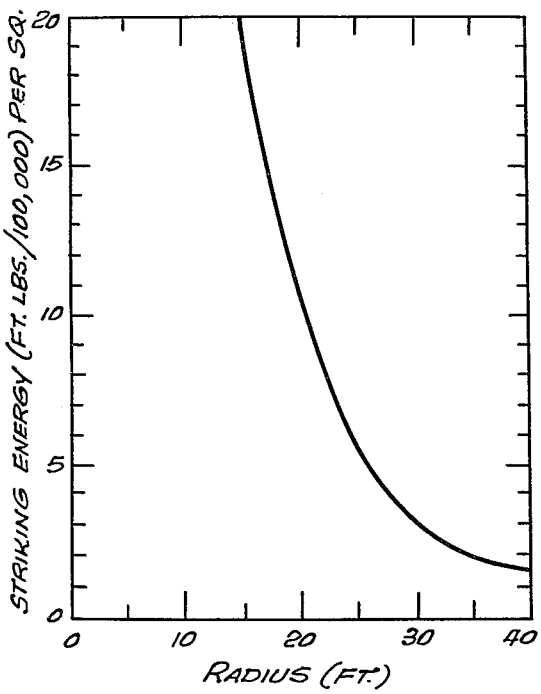

The particular advantage of the embodiment illustrated in FIGS. 5–8 is the relatively obvious fact that the fragments blasted from the metal casing can proceed outwardly through the ruptured portion of the warhead without meeting the resistance of the casing wall. At least, in the embodiment shown in FIGS. 5–8, it is relatively certain that at the time the main charge-firing initiator selected to fragment the casing or liner is fired, the arcuate portion of the casing opposite to the selected initiator has been hinged inwardly and therefore presents no resistance to the rapid expansion of the gases and the escape of the fragments along the target line. In the embodiment of FIGS. 2 and 3, there is no positive means for initially removing the arcuate portion of the casing diametrically opposite to the selected main, charge-firing initiator. However, even in this embodiment, it is reasonable to assume that when the selected main, charge-firing initiator is energized, the arcuate portion of the casing diametrically opposite to this initiator has been materially weakened and either has been removed or is disintegrating. In any event, the embodiment illustrated in FIGS. 2 and 3 has proven its effectiveness in actual tests which also have demonstrated a substantial improvement in the kill radius as compared to the more conventional 360° non-directional types of warheads. In particular, the kill radius of the warhead is increased in the manner apparent in the plots of FIGS. 10, 11 and 12. The embodiment of FIGS. 6 through 8 is presently preferred since the test results for it have shown about a 30 percent increase over the results shown in the plots of FIGS. 10 through 12. Apparently the reduced resistance to the fragments produced by the explosive breaking of the selected section of the casing is sufficient to achieve this improved performance.

Obviously many modifications and variations of the present invention are possible in the light of the above teachings. It is therefore to be understood that within the scope of the appended claims the invention may be practiced otherwise than as specifically described.

I claim:

1. A selectively-aimable warhead comprising:

a generally cylindrical warhead skin member, a generally cylindrical warhead casing member spaced radially inwardly of said skin member, a main explosive charge disposed in the space between said members, detonating means disposed inwardly of said skin member for disabling a selected arcuate section of the warhead skin, said means exerting a detonating force acting in a radially outward direction said selected skin section with a force magnitude below that required for detonating said main charge and above that required for disabling said selected section, and firing means for initiating a detonation of said explosive charge, said firing means being disposed to initiate said detonation in an area of the main explosive charge located approximately diametrically opposite said disabled arcuate section, and said main charge detonation having an inwardly-directed force sufficient to fragment a section of said casing member disposed in its initial propagation path whereby said fragments are explosively driven through said disabled section, the aimability of said warhead being achieved through the selection of said skin section to be disabled.

2. The warhead of claim 1 wherein said disabling means and said firing means both are provided respectively by first and second sets of detonating initiators;

each of said sets including a plurality of circumferentially-spaced initiators operatively disposed in the immediate vicinity of the skin section to be disabled and the casing section to be fragmented, said disabling means being provided by the initiators of said first set and said firing means provided by the initiators of said second set.

3. The warhead of claim 2 wherein said casing is metallic and is formed to produce fragments of a predetermined geometry.

4. The warhead of claim 2 wherein said casing is metallic and is provided with circumferentially-spaced longitudinally-extending structurally weakened portions, one of said disabling initiators being disposed in close proximity to each of said weakened portions for causing a detonation produced by said one initiator to rupture said casing along the longitudinal extent of its weakened portion and of further causing said ruptured sections of the casing to bend inwardly using adjacent weakened portions as hinges, whereby said inwardly bent sections are removed from the initial path of said explosive driven casing fragments.

5. The warhead of claim 4 wherein said weakened portions are in the form of longitudinal notches provided on the outer surface of the casing.

6. The warhead of claim 5 wherein said disabling means are separate flexible sheets each formed of an initiator-fired explosive charge and each being disposed in a substantially flush relationship with a portion of the outer surface of said casing.

7. The warhead of claim 6 wherein said casing is formed with an outer wall provided with a series of troughs separated one from another by a ridge, said disabling members being disposed one in each of said troughs whereby each disabling member is protectively separated from its adjacent member by said troughs.

* * * * *